United States Patent [19]

Wong et al.

[11] Patent Number: 4,894,127

[45] Date of Patent: Jan. 16, 1990

[54] METHOD FOR ANODIZING ALUMINUM

[75] Inventors: Chun-Ming Wong; Yukimori Moji, both of Seattle, Wash.

[73] Assignee: The Boeing Company, Seattle, Wash.

[21] Appl. No.: 356,099

[22] Filed: May 24, 1989

[51] Int. Cl.[4] ..... C25D 11/08

[52] U.S. Cl. ..... 204/58.5

[58] Field of Search ..... 204/58.5

[56] References Cited

U.S. PATENT DOCUMENTS

| | | | |
|---|---|---|---|
| 2,076,904 | 4/1937 | Lilienfeld | 175/315 |
| 2,150,395 | 3/1939 | Nagata | 148/6 |
| 2,262,967 | 11/1941 | Basel | 204/58 |
| 3,025,441 | 3/1962 | West | 317/258 |
| 3,616,297 | 9/1968 | Cooke | 204/35 |
| 3,836,439 | 9/1974 | Ikegaya et al. | 204/58 |
| 4,115,212 | 9/1978 | Patrie et al. | 204/38 |
| 4,467,027 | 8/1984 | Yamamoto et al. | 430/302 |

FOREIGN PATENT DOCUMENTS

| | | |
|---|---|---|
| 239743 | 3/1969 | U.S.S.R. . |
| 1127098 | 9/1968 | United Kingdom . |

*Primary Examiner*—T. M. Tufariello

*Attorney, Agent, or Firm*—Elizabeth F. Harasek; B. A. Donahue

[57] ABSTRACT

A controlled method of anodizing aluminum comprises formation of an aqueous solution of sulfuric and boric acids, immersion of a workpiece in the solution maintained at about room temperature and controlled application of voltage to achieve a current density not greater than about 10 Amperes per square foot. Aluminum oxide coatings in the weight range of from about 200 to 600 milligrams per square foot applied in this manner have properties as good as or superior to coatings applied in traditional hexavalent chromium anodizing solutions.

4 Claims, 1 Drawing Sheet

ANODIC COATING WEIGHT OF 2024-T3 AND 7075-T6 ALUMINUM ALLOYS SHOWING EFFECT OF ANODIZING TIME OF $H_3BO_3$-$H_2SO_4$ ANODIZE

ELECTROLYTE: $H_2SO_4$----5%
$H_3BO_3$----1%
POTENTIAL 15 VOLTS
TEMP: 75° F
CURRENT DENSITY: 6 AMP/ft$^2$
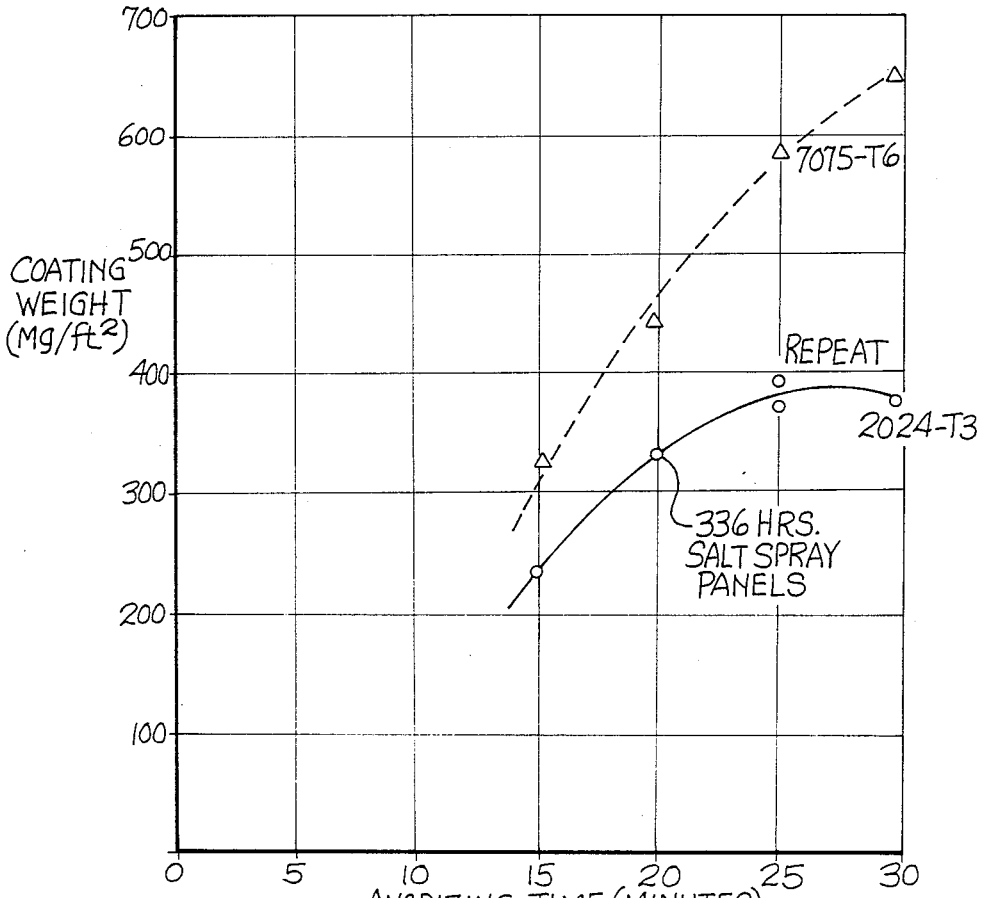
ANODIC COATING WEIGHT OF 2024-T3 AND 7075-T6 ALUMINUM ALLOYS SHOWING EFFECT OF ANODIZING TIME OF $H_3BO_3$-$H_2SO_4$ ANODIZE

METHOD FOR ANODIZING ALUMINUM

BACKGROUND

This invention relates to an improved method of anodizing aluminum and its alloys without the use of chromium-containing chemicals. More particularly, the invention relates to a method of using aqueous solutions of sulfuric and boric acids to achieve desired coating weights under well controlled conditions. Aluminum alloys are susceptible to corrosion, especially in a saline environment. Currently, the preferred method of protecting aluminum and its alloys from corrosion is to form a layer of aluminum oxide about 1 to 3 microns (about 200 to 600 mg/ft$^2$) thick by anodizing in a chromic acid solution. This oxide coating is then sealed in hot deionized water or dilute chromic acid, e.g., and may be further coated with a paint or other organic composition. In some cases, paint may be applied directly to the oxide coating before it is sealed.

Because of the difficulties of handling chromium-containing anodizing tank effluents and more recently the stringent restrictions on allowable chromates in the atmosphere, efforts have been directed towards the creation of anodizing methods without chromium. One alternative is anodization in relatively strong aqueous solutions of sulfuric acid.

The problem with this method is that it is difficult to control coating weights and that thin coatings formed by anodizing in sulfuric acid are not as corrosion resistant or paint receptive as like coating weights formed by anodizing in chromic acid. Furthermore, at and above the military minimum aluminum oxide coating weight specification of 3 microns aluminum oxide (600 mg/ft$^2$) for aluminum or aluminum alloys anodized in sulfuric acid (MIL-A-8625E), the aluminum substrate experiences unacceptable degradation of fatigue resistance.

Thick aluminum oxide coatings (greater than 5 microns) have been applied to substantially pure aluminum and 5000 series alloys by subjecting them to high current density (greater than 13 Amps per square foot) anodization in solutions of sulfuric and boric acids. This method is described in Japanese Patent No. 54-26983 and in the Journal of the Electrochemical Society, Vol. 129, No. 9, pp. 1865–68 (1982).

Efforts to coat modern aircraft alloys of the 2000, 6000 and 7000 series were unsuccessful using the method of these references. In some areas of test panels the coating was too thick and in others, no coating was applied and the metal was discolored. No success was achieved in obtaining uniform, adhesive coatings in the thickness range of about 1 to 3 microns.

BRIEF SUMMARY

In a preferred practice of the method of this invention, an aluminum alloy is provided with a protective aluminum oxide coating in the preferred thickness range of about 1 to 3 microns by anodizing in a bath containing low concentrations of sulfuric and boric acids. The method comprises providing an aqueous anodizing solution of about 3 to 5 weight percent sulfuric acid, from about 0.5 to 1 percent boric acid and not more than about 3.7 percent aluminum or 0.2 percent chloride ion. The bath is maintained at about room temperature.

An aluminum alloy workpiece is immersed in the bath where it is the anode. The voltage applied across the workpiece is ramped from about 5 to about 15 volts to maintain a substantially uniform current density that on the average does not exceed about ten amperes per square foot. The workpiece is maintained in the bath to achieve an aluminum oxide coating weight between about 200 and 600 milligrams per square foot. The anodized workpiece may thereafter be sealed and coated.

DETAILED DESCRIPTION

The sole figure is a plot of anodizing time (minutes) versus coating weight (mg/ft$^2$) for 2024 and 7075 aluminum alloys anodized in a 5% sulfuric acid and 1% boric acid bath at 75° F., 15 V peak and a current density of 6 A/ft$^2$.

The anodizing method of this invention is effective for applying an aluminum oxide coating on aluminum with a chromium-free solution of sulfuric and boric acids. The anodized coating produced is at least comparable to and, in terms of corrosion resistance, superior to like anodic coatings applied in chromium ion containing baths.

Prior art processes involving sulfuric acid and sulfuric acid-boric acid anodizing baths required and resulted in relatively high coating weights. Such weights were desired to obtain acceptable surface protection. The subject method provides lower coating weight aluminun oxide coatings with corrosion resistance and paint adhesion properties at least as good as those of these prior art thicker coatings. Furthermore, the subject method controls the coating weight of anodized products by carefully regulating anodizing rates.

In a typical preferred practice, an aluminum alloy workpiece is degreased and subjected to alkaline cleaning followed by a deoxidizing rinse.

A bath is made up of about 3 to 5 weight percent sulfuric acid and about 0.5 to 1 weight percent boric acid. This is about 30.5 to 52 g/l sulfuric acid and about 5.2 to 10.7 g/l boric acid. The bath should contain no more than about 3.7 g/l aluminum ions and 0.2 g/l chloride ions to insure controlled anodizing conditions.

In the following examples, the sulfuric acid was 66° Baume commercial grade and the boric acid was technical grade. Unless otherwise noted, the anodizing bath comprised 45 g/l sulfuric acid and 8 g/l boric acid.

The workpiece was hung or mounted on a conductive titanium rack and lowered into the anodizing bath with the current on or with the current off so long as it was applied within a few minutes. The voltage was ramped up from an initial value of 5 Volts or less to a maximum of about 20, and preferably about 15±1, Volts at a rate not exceeding about 5 Volts/minute. The bath was agitated during anodizing.

Aluminum alloys with Aluminum Association designations in the 2000 and 7000 series are used in modern aircraft particularly the 2024, 2324, 7050, 7150, 7178 and 7075 alloys. We have found that it is necessary to use a relatively low current density in order to apply thin but tough anodized coatings to these alloys in sulfuric-boric acid solutions. The preferred current density is less than 10 A/ft$^2$ and preferably about 5±2 A/ft$^2$. The Preferred current density is also a function of the alloy to be anodized.

The bath was maintained at room temperature of about 80° F. The preferred temperature range for anodizing in our method is near room temperature, preferably in the range of about 80°±10° F., and most preferably about 76° to 84° F. Heating and cooling means may be provided for anodizing tanks as needed.

We have also found that the anodized coatings formed by our method are most effective for corrosion protection and as a substrate for paints and other coatings without causing any substantial loss of stress fatigue when they have coating weights between about 200 and 600 mg/ft$^2$. The 7000 series alloys are particularly susceptible to loss of stress fatigue properties when too heavy an anodized coating of aluminum oxide is applied.

The figure shows anodizing time as a function of coating weight for 2024-T3 and 7075-T6 bare sheet anodized in a 5% sulfuric acid, 1% boric acid bath at a final potential of 15 V, a temperature of 75° F., and a current density of 6 A/ft$^2$. It can be seen from the figure that the 7075-T6 alloy is best coated by our method for short times at lower current densities than the other two alloys. They reach a near equilibrium state where coating weights in the desired range are achieved over a wide range of anodizing times.

The anodized coatings of this invention can be sealed and coated in the same manner as anodized coatings formed in chromate baths. For example, sealing may be accomplished in a dilute chromium solution or deionized water. The anodized aluminum may also be painted as formed or after sealing.

We have found that by adjusting the variables of our sulfuric acid-boric acid anodizing method as described herein, we can achieve unexpected and improved result over prior methods. The most critical variables are current density, bath composition, voltage and anodizing time to achieve the desired result of thin, tough and porous anodized coatings.

EXAMPLES

The following examples are included to illustrate to one of ordinary skill how to practice the subject invention. They are intended to illustrate the advantages of the present invention, but are not in any way intended to narrow or otherwise limit the scope of protection granted by the Letters Patent hereon.

EXAMPLE 1

Test panels 3×10×0.04 inch were anodized by immersion in an agitated solution, by weight, of 5% $H_2SO_4$ and 1% $H_3BO_3$ with the current on at an initial voltage of 5 volts. The anodizing racks were made of titanium from which the anodic coating was stripped before each reuse. The voltage was ramped at a rate of 5 Volts/minute up to 15 Volts. The current density was maintained at 6 A/ft$^2$ at a bath temperature of 75° F. for 20 minutes.

After anodizing, the panels were sealed by one of the following methods: immersion in deionized water at 180° F. for 30 minutes; immersion in 45 ppm hexavalent chromium, pH 3.5, at 195° F. for 25 minutes; or immersion in 45 ppm hexavalent chromium from sodium chromate, pH 3.5, at 205° F. for 20 minutes.

The salt spray test was conducted by exposing the panels to a 5% aqueous sodium chloride fog at 95° F. for 336 hours (2 weeks) in accordance with ASTM B117. The determination whether the panel passed or failed was made in accordance with military specification MIL-A-8625E The coating adhesion test, commonly referred to as a "crazing test" was conducted by applying a thin coat, on the order of 1–2 mils, of a two-part epoxy fuel tank primer equivalent to military specification MIL-C-27725 to each of the panels. After the primer was cured, an aluminum rod with ends rounded to 0.12 inches was scraped across the primed surface at an angle of 45° to score it. If the primer removed had a width greater than ⅛ in., the adhesion of the primer to the test panel was termed a failure. If the width of the removal path was narrower, the panel passed.

The results of these tests are set out in Table I where "P" signifies passed. Table I also reports data obtained in like manner for panels conventionally anodized in a 40 g/l chromate solution to a coating weight of 270 mg/ft$^2$ for alloy 2024-T3 and 320 mg/ft$^2$ for alloy 7075-T6. Referring again to the figure in connection with Table I, the 2024-T3 and 7075-T6 samples were each anodized for twenty minutes, the former thereby having a coating weight of about 330 mg/ft$^2$ and the latter about 440 mg/ft$^2$.

TABLE I

| ANODIZE | SEAL | ALLOY | 336 HOUR SALT SPRAY | PAINT ADHESION |
|---|---|---|---|---|
| | $H_2O$ | 2024-T3 | P | P |
| | | 7075-T6 | P | P |
| $CrO_3$ | Dilute $Cr^{+6}$ | 2024-T3 | P | P |
| | | 7075-T6 | P | P |
| | $Na_2Cr_2O_7$ | 2024-T3 | P | * |
| | | 7075-T6 | P | * |
| $H_2SO_4$ | $H_2O$ | 2024-T3 | P* | P |
| | | 7075-T6 | P | P |
| $H_3BO_3$ | | | | |
| | Dilute $Cr^{+6}$ | 2024-T3 | P | P |
| | | 7075-T6 | P | P |
| | $Na_2Cr_2O_7$ | 2024-T3 | P | * |
| | | 7075-T6 | P | * |

* Marginal

All of the samples passed the adhesion and corrosion tests. The 2024-T3 sample sealed in deionized water passed the salt spray only marginally with a greater than desired number of pinpoint corrosion spots but no large areas of corrosion like those of clearly failed samples.

EXAMPLE 2

Test samples were prepared as in Example 1 but the concentrations, in weight percent, of the sulfuric and boric acids were varied as shown in Table 2. The temperature and current density were also varied as indicated and the samples were sealed in dilute chromic acid. Two Samples each of the 2024-T3 and 7075-T6 alloys were subjected to the 336 hour salt spray test described in Example 1. The results are reported in TABLE II on a scale of 10 to 6 where 10 represents no corrosion and 6 is failure with more than 11 pits per panel. Where a pit is a visible corrosion mark less than ⅛ in. in diameter. The coating weights were determined by the method specified in section 4.5.2.1 of MIL-A-8625E.

TABLE II

| $H_2SO_4$ (%) | $H_3BO_3$ (%) | TEMP (°F.) | COATING WT. (mg/ft$^2$) 2024-T | COATING WT. (mg/ft$^2$) 7075-T6 | 336 Hrs. Salt Spray* 2024-T3 | 336 Hrs. Salt Spray* 7075-T6 | Current Density (amp/ft$^2$) |
|---|---|---|---|---|---|---|---|
| 3 | 0.5 | 75 | 223/214 | 340/326 | 10,9 | 10,9 | 2.7 |

TABLE II-continued

| $H_2SO_4$ (%) | $H_3BO_3$ (%) | TEMP (°F.) | COATING WT. ($mg/ft^2$) 2024-T | 7075-T6 | 336 Hrs. Salt Spray* 2024-T3 | 7075-T6 | Current Density ($amp/ft^2$) |
|---|---|---|---|---|---|---|---|
| | | 85 | 275 | 423 | 8,8 | 9,9 | 3.7 |
| 3 | 1 | 75 | 209 | 319 | 8,7 | 9,10 | 2.9 |
| | | 85 | 280 | 425 | 8,9 | 9,10 | 4.0 |
| 5 | 0.5 | 75 | 304 | 492 | 10,9 | 10,10 | 4.1 |
| | | 85 | 401 | 644 | 10,10 | 10,10 | 6.1 |
| 5 | 1 | 75 | 306 | 495 | 10,9 | 10,9 | 4.2 |
| | | 85 | 389 | 628 | 8,10 | 10,10 | 5.7 |

*Corrosion Rating Scale; 10-no corrosion; 9-1 to 2 pits; 8-3 to 5 pits; 7-6 to 10 pits (marginal pass); 6- more than 11 pits.

Referring to Table 2, only one sample of a relatively low coating weight 2024-T3 alloy had a marginal scale value of 7. All the other samples performed very well in the salt spray. Like samples anodized to like coating weights in chromic acid tend to discolor and pit in salt spray testing at coating weights below about 300 $mg/ft^2$. These boric acid-sulfuric acid anodized samples showed no discoloration and smaller corrosion spots than the chromic acid anodized samples.

EXAMPLE 3

Notched round specimen of 7075-T6 alloy, 0.26 in in diameter, were anodized and tested in an MTS 10K#1 fatigue test machine using phenolic shims and hydraulic grips. The tests were run at a frequency of 30 Hz, a stress ratio of −0.5, and a stress level that varied from 22 to 25 ksi. All tests were conducted in ambient laboratory air.

Five sample that were anodized in chromic acid at 22 volts, for 35 minutes at 95° F. averaged 273,920 cycles before failure. Seven samples that were anodized in 23 oz. sulfuric acid per gallon of water at 15 V for 11 minutes at 70° F. averaged only 84,757 cycles before failure. Seven sample anodized in 5% sulfuric/1% boric acids at 15 V for 20 minutes at 80° F. averaged 158,957 cycles before failure. The tests were repeated for other samples anodized in chromic acid and sulfuric/boric acid to result in like coating weights of about 300, 450 and 600 mg/ft as set out in Table 3.

TABLE III

CORRELATION OF COATING WEIGHT & THICKNESS ON 7150-T651 ALUMINUM PLATE

| PROCESS | PROCESS | COATING WEIGHT ($mg/ft^2$) | FILM THICKNESS (um) |
|---|---|---|---|
| Chromic | P-1 | 300 | 1.6 |
| Acid | P-2 | 430 | 2.4 |
| Anodize | P-3 | 569 | 2.9 |
| Boric Acid/ | P-1 | 341 | 1.8 |
| Sulfuric | P-2 | 489 | 2.4 |
| Acid | P-3 | 637 | 3.6 |
| Anodize | | | |

P-1: 52 mg free $C_r^{+6}$/liter, 24 Volts, 99° F. for 27 minutes, 30 seconds anodize.
P-2: Same as P-1 except anodized for 43 minutes, 30 seconds.
P-3: Same as P-1 except anodized for 62 minutes.
P-4: 49.6 gm $H_2SO_4$/liter and 10 gm $H_3BO_3$150 Volts, 83° F. for 10 minutes 55 seconds anodize.
P-5: Same as P-4 except anodized for 17 minutes 55 seconds.
P-6: Same as P-4 except anodized for 25 minutes.

Fatigue test results for the chromic acid and the sulfuric acid/boric acid anodized samples were equivalent and acceptable.

CONCLUSION

From the foregoing specification and examples, one of ordinary skill will readily understand that when the sulfuric acid-boric acid anodizing parameters set forth above are followed, a superior anodized coating results by means of a more environmentally sound process than anodizing in chromic acid. The present invention has therefore been so disclosed that one of ordinary skill will be able to make and use the invention and effect various changes, alterations and substitutions of equivalents without departing from the broad concepts herein disclosed. It is therefore intended that the scope of Letters Patent issued hereon be limited only by the definition contained in the appended claims and equivalents thereof.

The embodiments of the invention in which an exclusive property or privilege is claimed are defined as follows:

1. An improved method of anodizing an aluminum alloy workpiece comprising the steps of:

providing an aqueous anodizing solution consisting essentially by weight of about 3 to 5 percent sulfuric acid, from about 0.5 to 1 percent boric acid and not more than about 3.7 percent aluminum ion and 0.2 percent chloride ion;

maintaining said bath at a temperature from about 70 to about 90 degrees F;

immersing said workpiece in said bath;

ramping the voltage applied across said workpiece in said bath from about 5 to about 20 volts; such that the current density is substantially uniform across the workpiece and the average current density does not exceed about 10 amperes per square foot; and maintaining said workpiece in said bath for a time such that an adherent coating of aluminum oxide is applied thereto having a coating weight between about 200 and 600 milligrams per square foot.

2. The method of claim 1 further characterized by sealing said coating in a dilute solution of hexavalent chromium ion.

3. The method of claim 1 further characterized by sealing said coating in deionized water.

4. An improved method of anodizing an aluminum alloy comprising the steps of immersing a workpiece into an anodizing solution consisting essentially by weight of about 3 to 5 percent sulfuric acid, from about 0.5 to 1 percent boric acid and not more than about 3.7 percent aluminum ion and 0.2 percent chloride ion; maintaining said bath at a temperature from about 70 to about 90 degrees F; applying from about 5 to 15 Volts across the workpiece such that average current density does not exceed about 10 amperes per square foot; and maintaining said workpiece in said bath for a time such that an adherent coating of aluminum oxide is applied thereto having a coating weight between about 200 and 600 milligrams per square foot, which coating does not substantially reduce the fatigue resistance of the workpiece.

* * * * *